US006011386A

United States Patent [19]

Li et al.

[11] Patent Number: 6,011,386

[45] Date of Patent: Jan. 4, 2000

[54] FREQUENCY ADJUSTABLE, ZERO TEMPERATURE COEFFICIENT REFERENCING RING OSCILLATOR CIRCUIT

[75] Inventors: Wen Li; Manny K. F. Ma, both of Boise, Id.

[73] Assignee: Micron Technology, Inc., Boise, Id.

[ * ] Notice: This patent is subject to a terminal disclaimer.

[21] Appl. No.: 08/911,897

[22] Filed: Aug. 15, 1997

Related U.S. Application Data

[63] Continuation of application No. 08/631,993, Apr. 15, 1996, Pat. No. 5,661,428.

[51] Int. Cl.[7] ..... G05F 3/08

[52] U.S. Cl. ..... 323/313

[58] Field of Search ..... 323/313, 314, 323/315, 316; 327/534, 538, 513; 331/51

[56] References Cited

U.S. PATENT DOCUMENTS

| | | | |
|---|---|---|---|
| 4,387,503 | 6/1983 | Aswell et al. | 29/575 |
| 5,126,590 | 6/1992 | Chern | 307/296 |
| 5,182,529 | 1/1993 | Chern | 331/57 |

OTHER PUBLICATIONS

Yoo, H., et al., "A Precision CMOS Voltage Reference with Enhanced Stability for the Application to Advanced VLSI's", *1993 IEEE International Symposium on Circuits and Systems*, vol. 2 of 4, 1318–1321, (May 3–6, 1993).

*Primary Examiner*—Peter S. Wong
*Assistant Examiner*—Rajnikant B. Patel
*Attorney, Agent, or Firm*—Schwegman, Lundberg Lundberg & Kluth P.A.

[57] ABSTRACT

A frequency adjustable, zero temperature coefficient referencing ring oscillator circuit includes a plurality of inverter stages each having a switching circuit that produces the oscillating output signal for the ring oscillator circuit and a control circuit that controls the switching circuit to establish the frequency of the output signal, the control circuit including field-effect transistors which are operated as output resistance controllable devices and which have their operating points, and thus their output resistances, established by a reference voltage that is produced by a precision reference voltage generating circuit so that the operating frequency of the ring oscillator circuit can be set by adjusting the value of the reference signals produced by the precision reference signal generating circuit and is maintained at the setpoint value because the precision reference voltage generating circuit operates independently of variations in temperature and/or the power supply voltage. The ring oscillator circuit is fabricated as an integrated circuit device and the operating frequency of the integrated circuit ring oscillator circuit can be adjusted after fabrication and passivation of the integrated circuit device.

15 Claims, 3 Drawing Sheets

FREQUENCY ADJUSTABLE, ZERO TEMPERATURE COEFFICIENT REFERENCING RING OSCILLATOR CIRCUIT

This application is a continuation of Ser. No. 08/631,993 filed Apr. 15, 1996 U.S. Pat. No. 5,661,428.

FIELD OF THE INVENTION

The present invention relates to ring oscillator circuits, and more particularly, to an integrated circuit ring oscillator circuit including a reference signal source the operation of which is independent of temperature, and wherein the operating frequency of the integrated circuit ring oscillator circuit can be adjusted after fabrication and passivation.

BACKGROUND OF THE INVENTION

There are many applications in which highly stable oscillators are required, both in integrated circuit systems and in discrete systems. For example, in integrated circuit systems, highly stable oscillators are required for counters, frequency dividers, frequency multipliers, phase locked loops, charge pumps, and any other circuit which requires a constant clock frequency. Ring oscillator circuits frequently are used to provide the clock frequency in integrated circuit systems because ring oscillators lend themselves to fabrication using integrated circuit techniques. When a ring oscillator circuit is used to provide a time base in a digital system, the operating frequency of the ring oscillator circuit must be free from frequency drift caused for by variations in temperature or supply voltage. Various methods have been used to minimize the effects of temperature and supply voltage variations on circuit operation, including the use of complementary circuit stages so changes due to temperature and voltage variations offset one another. There is a need for a ring oscillator circuit formed by integrated circuit techniques and that includes a reference signal source that operates independently of variations in temperature.

A further consideration is that for oscillator circuits and other time base generating circuits that are formed by integrated circuit techniques, the operating frequency must be established during batch processing by producing a component, such as a resistance, of the oscillator circuit to have the value that is required to provide the desired operating frequency. Because the component values of integrated circuit devices are determined by the masks that are used in the production of the integrated circuit devices, the component values are fixed once the mask has been designed. Moreover, characteristics, such as the operating frequency of an oscillator formed on an integrated circuit device, cannot be verified until after batch processing and passivation of the integrated circuit device. Consequently, if after testing it is found that the operating frequency of such oscillator is not the desired frequency, the integrated circuit device which includes the oscillator cannot be used and design of the integrated circuit device has to be altered, for example, by taping out the mask to allow production of integrated circuit devices in which the oscillator circuit has the proper operating frequency. This results in increased production time and increased costs. Thus, there is a need to be able to adjust the frequency of an integrated circuit oscillator after fabrication and passivation of the integrated circuit oscillator.

For the reasons stated above, and for other reasons stated below which will become apparent to those skilled in the art upon reading and understanding the present specification, there is a need in the art for an oscillator circuit that can be formed as an integrated circuit device, and which includes a reference signal source, the operation of which is independent of variations in temperature, and wherein the operating frequency of the integrated circuit oscillator can be adjusted in a simple manner after fabrication and passivation of the integrated circuit oscillators.

SUMMARY OF THE INVENTION

The present invention provides a frequency adjustable, zero temperature coefficient referencing ring oscillator circuit having a plurality of cascaded inverter stages connected in a ring for producing an oscillating output having rising and falling transitions. Each inverter stage includes a switching circuit and a control circuit. The switching circuit for each inverter stage includes at least one semiconductor switching device. The control circuit for each inverter stage includes at least one output resistance controllable semiconductor device that has an output circuit for electrically coupling the switching device to a power source. A reference signal source is electrically coupled to the control circuit of each inverter stage for deriving from a supply voltage provided by the power source a reference signal for biasing the output resistance controllable semiconductor devices of each inverter stage at an operating point that provides an output resistance for the control circuit of each inverter stage that establishes the frequency of the output signal at a preselected value. In accordance with a preferred embodiment, the reference signal source has a zero temperature coefficient and operates independently of variations in the supply voltage. Moreover, in the preferred embodiment, the ring oscillator circuit is produced using integrated circuit techniques and the amplitude of the reference signal provided by the reference signal source is adjustable after fabrication of the integrated circuit device to permit adjustment in the operating frequency after fabrication has been completed.

Further in accordance with the invention, there is provided a method of providing an oscillating output signal having rising and falling transitions. The method comprises providing a plurality of inverter stages with each inverter stage including a switching circuit and a control circuit. The switching circuit for each inverter stage includes at least one semiconductor switching device and the control circuit for each inverter stage includes at least one output resistance controllable semiconductor device having an output circuit for electrically coupling the switching device to a power source. The method additionally includes connecting the plurality of cascaded inverter stages in a ring to form a ring oscillator circuit having an input and an output for producing the oscillating output signal at the output of the ring oscillator circuit, and controlling the output resistance controllable semiconductor devices of each inverter stage to establish the output resistances of the output resistance controllable semiconductor devices at values that provide a desired frequency for the output signal.

DESCRIPTION OF A PREFERRED EMBODIMENT

In the following detailed description of a preferred embodiment, reference is made to the accompanying drawings that form a part hereof, and in which are shown by way of illustration specific embodiments in which the invention may be practiced. It is to be understood that other embodiments may be utilized and structural changes may be made without departing from the scope of the present invention.

The frequency adjustable, zero temperature coefficient referencing ring oscillator circuit provided by the present invention can be used in any integrated circuit system or any discrete system that requires a constant clock frequency. For example, in integrated circuit systems, stable oscillators are used in counters, frequency dividers, frequency multipliers, phase locked loops, charge pumps, and other circuits wherein a constant frequency is required. Although in the preferred embodiment, the ring oscillator circuit is produced using integrated circuit techniques, the ring oscillator circuit can be produced as a discrete circuit.

Figure 1:
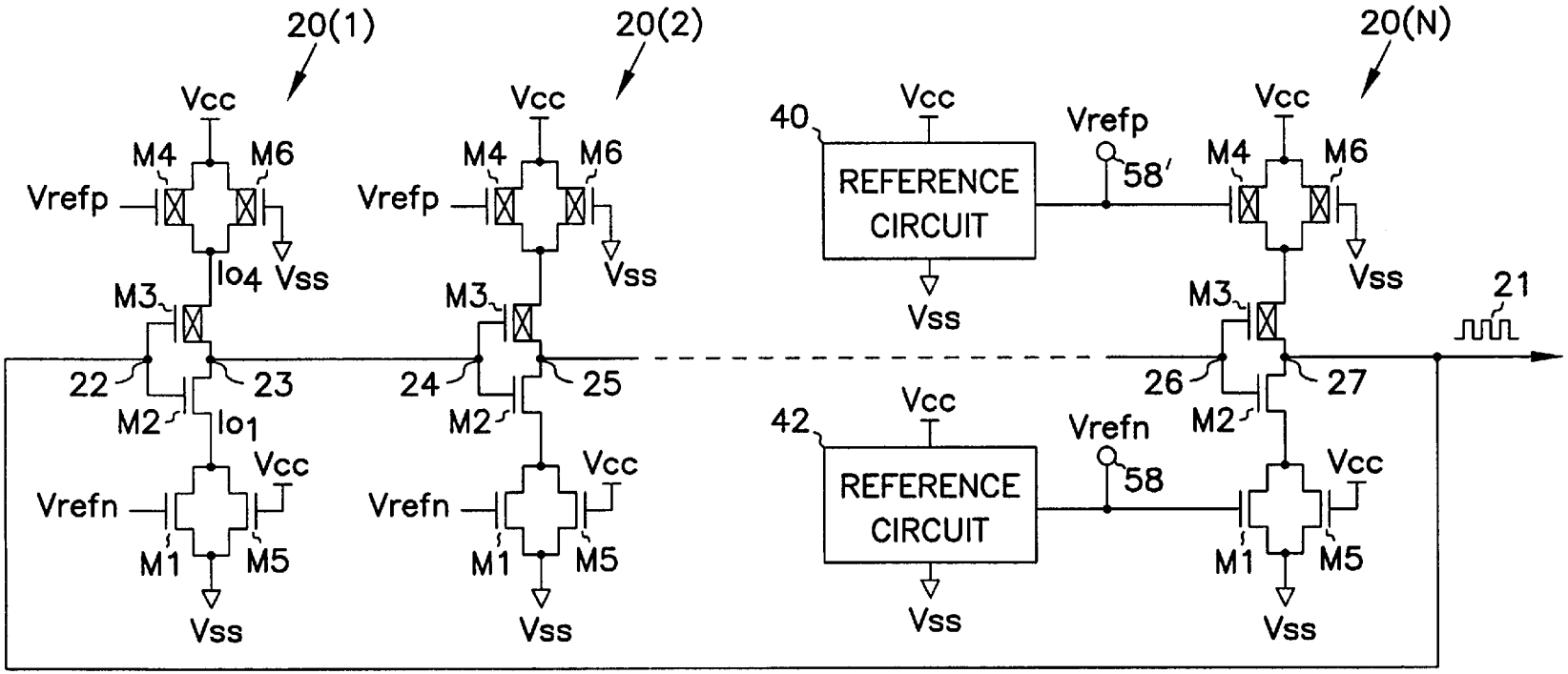
FIG. 1 is a schematic circuit diagram of a ring oscillator circuit provided by the present invention.

Referring to the drawings, FIG. 1 is a schematic circuit diagram of the ring oscillator circuit provided by the present invention. The ring oscillator circuit includes an odd number "N" of cascaded inverter stages, three of which are illustrated in FIG. 1 and given the reference numbers 20(1), 20(2) and 20(N). The inverter stages are connected in a serially connecting ring fashion with the output of each inverter stage being coupled to the input of the succeeding inverter stage in the ring and with the output of the last inverter stage 20(N) being coupled to the input of the first inverter stage 20(1). Thus, the output of inverter stage 20(1) at node 23 is connected the input of inverter stage 20(2) at node 24. The output of inverter stage 20(2) at node 25 is connected the input of inverter stage 20(N) at node 26. The output of inverter stage 20(N) at node 27, which is the output of the ring oscillator circuit in the exemplary embodiment, is connected the input of inverter stage 20(1) at node 22, which is the input of the ring oscillator circuit The exact number "N" of inverter stages can be any odd number, three or greater, depending upon the delay through each stage and the frequency of oscillation that is desired for the ring oscillator circuit.

In the exemplary embodiment, each inverter stage, such as inverter stage 20(1), includes six semiconductor devices embodied as CMOS field-effect transistors M1–M6. Field-effect transistor M1, field-effect transistor M2 and field-effect transistor M5, hereinafter M1, M2 and M5, respectively, are N-channel field-effect transistors each having a gate, a first current node or drain, and a second current node or source. Field-effect transistor M3, field-effect transistor M4 and field-effect transistor M6, hereinafter M3, M4 and M6, respectively, are P-channel field-effect transistors each having a gate, a first current node, or source, and a second current node, or drain.

M2 and M3 are connected in series with one another and have their gates connected to node 22 at the input of the ring oscillator circuit. The drain of M2 and the drain of M3 are commonly connected to node 23. M1 and M5 are connected in parallel with one another, with respective drain electrodes commonly connected to the source electrode of M2 and with respective source electrodes commonly connected to $V_{ss}$. The gate of M1 is connected to the output 58 of a reference signal source 40 that provides a precision reference voltage Vrefn. The gate of M5 is connected to $V_{cc}$. Similarly, M4 and M6 are connected in parallel with one another, with respective source electrodes commonly connected to $V_{cc}$ and with drain electrodes commonly connected to the source electrode of M3. The gate of M4 is connected to the output 58' of a reference signal source 42 that provides a precision reference voltage Vrefp. The gate of M6 is connected to $V_{ss}$.

M2 and M3 are operated as a switching circuit for switching the signal output of the inverter stage 20(1) between $V_{cc}$ and $V_{ss}$ as a function of the voltage applied to the gates of M2 and M3. A typical value for the supply voltage $V_{cc}$ referred to herein is 3.3 volts and $V_{ss}$ is zero volts or ground connection for the ring oscillator circuit It will be understood that different voltage levels could be used and are not intended to limit the scope of the present invention. The ring oscillator circuit produces a transitioning or oscillating output signal, a portion of which is represented by waveform 21, having rising and falling transitions between high and low conditions. The terms "high" and "low" as used herein refer to $V_{cc}$ (supply voltage) and $V_{ss}$ or ground, respectively.

M1, M4, M5 and M6 form a control circuit that controls the operation of the switching circuit Parallel connected M4 and M6 are interposed between M3 of the switching circuit and $V_{cc}$. Parallel connected M1 and M5 are interposed between M2 of the switching circuit and $V_{ss}$.

The six field-effect transistors M1–M6 of the inverter stages 20(2)–20(N) are connected in the same manner as for inverter stage 20(1) with field-effect transistors M2 and M3 operating as a switching circuit and field-effect transistors M1, M4, M5, and M6 operating as a control circuit.

Figure 2:
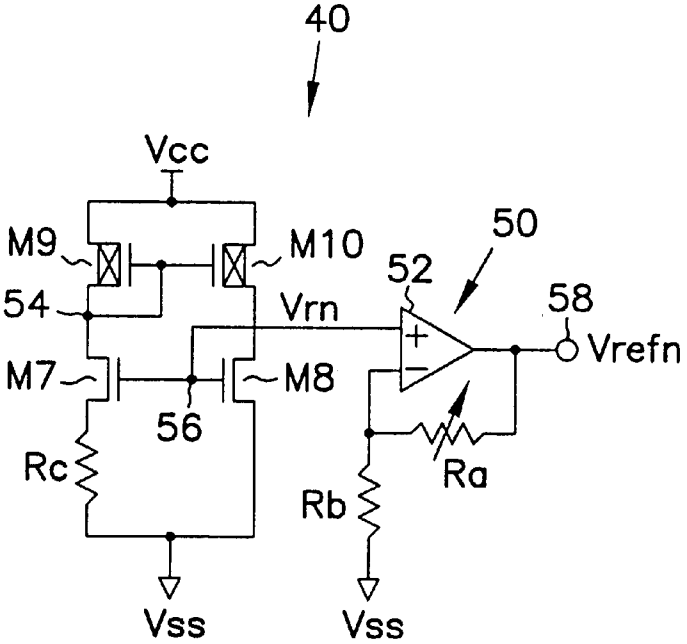
FIG. 2 is a schematic circuit diagram of a reference signal source for the n-channel device of the ring oscillator control circuit shown in FIG. 1.

Referring to FIG. 2, the reference signal source 40 that provides precision reference voltage Vrefn includes four semiconductor devices embodied as CMOS field-effect transistors M7–M10 and an amplifier circuit 50. The amplifier circuit 50 includes an operational amplifier 52 and feedback resistances Ra and Rb. The reference signal source 40 is similar to the reference voltage generator illustrated in FIG. 6 of an article by Hoi-Jun Yoo, et al., which is entitled "Precision CMOS Voltage Reference With Enhanced Stability for the Application to Advanced VLSI's", which appeared in the Proceedings—IEEE International Symposium on Circuits and Systems, Volume No. 2, 1993, pages 1318–1321 and which article is incorporated herein by reference.

Field-effect transistor M7 and field-effect transistor M8, hereinafter M7 and M8, respectively, are N-channel field-effect transistors. Field-effect transistor M9 and field-effect transistor M10, hereinafter M9 and M10, respectively, are P-channel field-effect transistors. M9 and M7 have their output circuits connected in series with a resistance Rc between $V_{cc}$ and $V_{ss}$. M8 and M10 have their output circuits connected in series between $V_{cc}$ and $V_{ss}$. The gates of M9 and M10 are commonly connected to node 54 which is connected to the junction of the output circuits of M9 and M7. The gates of M7 and M8 are commonly connected to the node 56 which is connected to the non-inverting input of the operational amplifier 52.

The operational amplifier 52 is connected for operation as a high gain, non-inverting amplifier with feedback resistances Ra and Rb establishing the gain of the amplifier. Resistance Ra is connected between the output of the operational amplifier and the inverting input of the operational amplifier. Resistance Rb is connected between $V_{ss}$ and the inverting input of the operational amplifier. The reference voltage Vrefn provided by the reference signal source 40 is a positive voltage the amplitude of which is given by equation (1):

$$Vrefn = \frac{(Ra + Rb)}{Rb} * Vrn \quad (1)$$

where Vrn is the voltage appearing at the gates of M7 and M8. The voltage Vrn is given by equation (2):

$$Vrn = Vth + \frac{2}{(R * \beta_8)} * [1 - (1/\sqrt{K})] \quad (2)$$

where Vthn is the threshold voltage of the N-channel field effect transistor M1 and $K=\beta_7/\beta_8$, with $\beta_7$ being the gain factor of M7 and $\beta_8$ being the gain factor for M8. Equation (2) corresponds to a correspondingly numbered equation that is set forth on page 1319 of the referenced article. As is disclosed in the referenced article, the magnitude of the reference voltage is independent of the external supply voltage.

Figure 3:
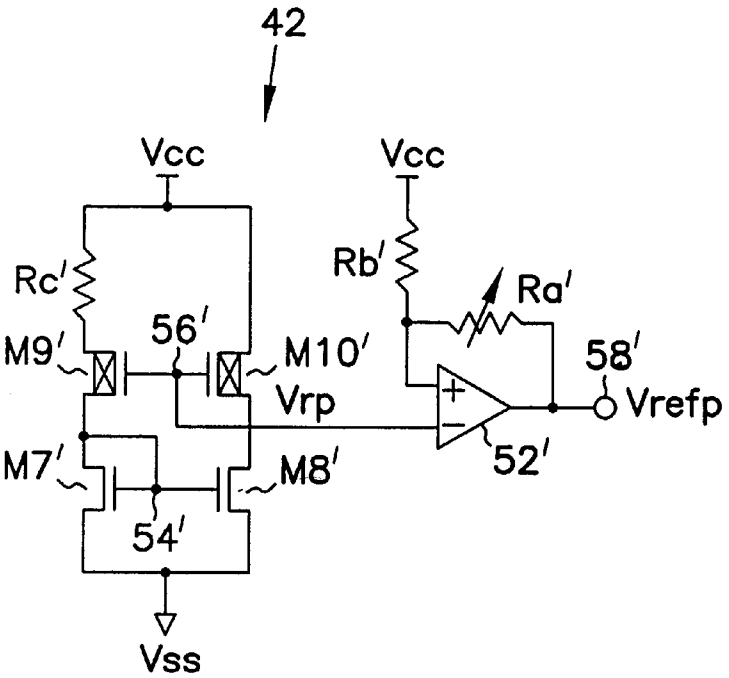
FIG. 3 is a schematic circuit diagram of a reference signal source for the p-channel device of the ring oscillator control circuit shown in FIG. 1.

Referring to FIG. 3, the reference signal source 42 that provides the precision reference voltage Vrefp is similar to reference signal source 40, but is complementary in structure to the reference signal source 40. Accordingly, the elements of reference signal source 42 have been given the same reference number as corresponding elements of reference signal source 40, but with a prime notation (′). In reference signal source 42, the resistance Rc′ is connected between $V_{cc}$ and M9′ and M7′. The gates of M7′ and M8′ are commonly connected to node 54′ which is connected to the output circuits of M9′ and M7′. The gates of M9′ and M10′ are commonly connected to node 56′ which is connected to the inverting input of the operational amplifier 52′. The reference voltage Vrefp is a positive voltage, the amplitude of which is greater than the amplitude of Vrefn and which is given by equation (3):

$$Vrefp = \frac{(Ra' + Rb')}{Rb'} * Vrp \quad (3)$$

where Vrp is the voltage appearing at the gates of M9′ and M10′ and is approximately equal to $V_{cc}$-Vrn.

As will be shown, the precision reference voltages Vrefn and Vrefp establish the operating points for n-channel device M1 and the opposite polarity p-channel device M4, thereby determining the output resistances of M1 and M4 which, in turn, determine the operating frequency for the ring oscillator circuit Thus, the reference signal sources derive from the supply voltage reference signals Vrefn and Vrefp for biasing the semiconductor devices M1 and M4 of the control circuit of each inverter stage at an operating point that provides an output resistance for the control circuit of each inverter stage that establishes the frequency of the output signal 21.

In accordance with another aspect of the invention, the resistances Ra and Ra′ which establish the values of the reference voltages Vrefn and Vrefp, respectively, are laser trimmable so that the reference voltages Vrefn and Vrefp, and thus the operating frequency of the ring oscillator circuit, can be adjusted after testing. This obviates the need to fabricate the reference voltage sources 40 and 42 to a precise resistance in order to obtain the reference voltage that is required to establish a desired operating frequency for the ring oscillator circuit.

Referring again to FIG. 1, M2 and M3 are operated in saturation and switch the output of the inverter stage between $V_{cc}$ and $V_{ss}$ as a function of the input signal level being applied to the input 22 of the inverter stage at the gates of M2 and M3. The size of the two field-effect transistors M2 and M3 is chosen so that the switching speed for the inverter stage "pulling up" and "pulling down" are approximately the same. M2 and M3 are selected so that their gain factors $\beta_2$ and $\beta_3$ are equal. In addition, $\beta_3$ is chosen to be about two to three times greater than $\beta_1$.

M1 and M4 function as output resistance controllable devices and have their output circuits connected for electrically coupling the switching devices M2 and M3 to the power source, i.e., between the supply voltage $V_{cc}$ and ground $V_{ss}$. The output circuits of M1 and M4 are connected in series with the output circuits of series connected M2 and M3. The output resistances of M1 and M4 are established by the values of the reference voltages Vrefn and Vrefp applied to the gates of M1 and M4, respectively. M1 and M4 are operated in the saturation region so that the output resistance Ro is defined as:

$$(4)\ R_o = 1/\lambda * I_o$$

where $\lambda$ is defined as the channel modulation coefficient, and Io is the current flowing through M1 and M4. The output resistance Ro varies inverse linearly with the current Io flowing through M1 and M4.

The current $Io_1$ flowing through M1 and M2 during "pulling down" cycles, i.e., when $V_{cc}$ is being applied to the gate of the switching transistors FET2 and FET 3, is:

$$I_{o1} = \frac{[\beta_1 * (Vrefn - Vthn)^2]}{2} \quad (5)$$

where $\beta_1$ is the gain factor for M1 and where Vthn is the threshold voltage of the N-channel field effect transistor M1.

Similarly, the current $Io_4$ flowing though M3 and M4 during cycles for the "pulling up" cycles, i.e., when $V_{ss}$ is applied to the gate of the switching transistors, is:

$$I_{o4} = \frac{[\beta_4 * (V_{cc} - Vrefp - Vthp)^2]}{2} \quad (6)$$

where Vthp is the threshold voltage of the P-channel field effect transistor M4. The threshold voltages Vthn and Vthp are assumed to be equal and a typical value for the threshold voltages is 0.7 volt.

The gain factor $\beta_1$ for the N-channel field-effect transistor M1 and the gain factor $\beta_4$ for the P-channel field-effect transistor M4 are selected so that the high-to-low transition time, tPHL, and the low to high transition time, tPLH, are equal for the inverter stage.

M5 and M6 are connected for low bias operation and are operated as minimum bias transistors for initiating the operation of the ring oscillator circuit in response to application of power to the ring oscillator circuit. M5 and M6 are selected so that the gain factor $\beta_5$ of M5 is equal to the gain factor $\beta_6$ of M6. Moreover, gain factor $\beta_5$ is much smaller than gain factor $\beta_1$. Although the preferred embodiment of the ring oscillator circuit includes the minimum bias transistors M5 and M6, transistors M5 and M6 are not necessary for proper operation of the ring oscillator circuit. However, the presence of M5 and M6 is advantageous in that these transistors speed up achieving of steady state operation at the oscillating frequency under power-up conditions. Once the reference voltages Vrefn and Vrefp have been established at the gates of M1 and M4, the start-up field-effect transistors M5 and M6 are ineffective because $\beta_1 >> \beta_5$ (of M5). Likewise for the gain factor $\beta_4$ of M4 and the gain factor $\beta_6$ of M6, $\beta_4 >> \beta_6$. Consequently, when Vrefn and Vrefp become well established, the output resistances of M1 and M4 control the frequency of oscillation of the ring oscillator circuit The frequency of oscillation of the ring oscillator circuit is given by by equation (7):

$$(7)\ f=1/(N*t)$$

where N is the number of inverter stages and "t" is the time delay constant for the inverter stage. The delay time constant "t" is given by equation (8).

$$(8)\ t=A*C_{ox}*R_o$$

where A is a process constant, Cox is the gate oxide capacitance, and Ro is the output resistance of the field-effect transistor.

Thus, the frequency of oscillation of the ring oscillator circuit is inversely proportional to $Ro_1+Ro_2$ (the output resistances of M1 and M2) during "pulling down cycles", and is inversely proportional to $Ro_3+Ro_4$ (the output resistances of M3 and M4) during "pulling up cycles". However, the output resistance $Ro_1$ of M1 is much larger than the output resistance $Ro_2$ of M2. Also, the output resistance $Ro_4$ of M4 is much larger than output resistance $Ro_3$ of M3. Therefore, the frequency of oscillation of the ring oscillator circuit is effectively determined by the output resistance of M1, during "pulling down" cycles, and by the output resistance of M4 during "pulling up" cycles.

The control circuit controls the time delay constant "t" of the inverter stage by establishing the resistances of the output circuit. The adjusting capability of the ring oscillator circuit frequency is achieved by controlling the values of resistances $Ro_1$ and $Ro_4$ through the precision reference voltages Vrefn and Vrefp. The output resistances $Ro_1$ and $Ro_4$ decrease with increase in the reference voltages Vrefn and $|V_{cc}$-Vrefp.|

The effect of adjusting resistance $Ro_4$ is to affect the speed of "pulling up". The resistances $Ro_1$ and $Ro_4$ are adjusted equally so that M1 and M4 have the same "pulling up" and "pulling down" speed. $Ro_1$ and $Ro_2$ are controlling for the positive, or "pulling down" cycles i.e., when voltage at level $V_{cc}$ is on the gate of the switching transistors and resistances $Ro_3$ and $Ro_4$ are controlling for the negative, or "pulling up" cycles i.e., when $V_{ss}$ is on the gate of the switching transistors M2 and M3.

Because resistance $Ro_1$>>resistance $Ro_2$, variation in the reference voltage Vrefn is the controlling element in setting the frequency of the ring oscillator circuit for "pulling down" cycles. Similarly, because resistance $Ro_4$>>resistance $Ro_3$, variation in the reference voltage Vrefp is the controlling element in setting the frequency of the ring oscillator circuit for "pulling down" cycles.

The gain factor $\beta_2$ for M2 is about three times the gain factor $\beta_1$ for M1, and the gain factor $\beta_1$ for M1 is much greater than the gain factor $\beta_5$ for M5. These conditions assure that the output resistances R1 and R4 of M1 and M4, respectively, are the controlling elements.

In accordance with a further aspect of the invention, the frequency of the ring oscillator circuit provided by the invention can be adjusted after fabrication and passivation of the integrated circuit device has been completed. For the purpose of setting the values of resistances Ra and Ra', the integrated circuit device is tested at two different times during the production of the integration circuit device. The first test is conducted after fabrication and passivation. This test is used to determine the initial operating frequency for the ring oscillator circuit as produced in the integrated circuit process. The second test is conducted after the resistances Ra and Ra' of the reference signal sources 40 and 42 have been laser trimmed in adjusting the operating frequency of the ring oscillator circuit to the value required to provide reference voltages that establish the operating frequency for the ring oscillator circuit at the design frequency.

In accordance with another aspect of the invention, the sources 40 and 42 of the precision voltage references Vrefn and Vrefp have a zero temperature coefficient in addition to operating independently of variations in the supply voltages $V_{cc}$ and $V_{ss}$. Thus, the reference voltages are independent of temperature variations as well as to variations in the supply voltages. The reference voltage Vrefn is given by equation (2) and is proportional to Vrn. The temperature variation of the voltage Vrn can be defined by equation (9):

$$\frac{dVrn}{dT} = \frac{dV_{th}}{dT} + \frac{2}{R\beta_7}\left[1 - \frac{1}{\sqrt{K}}\right]\left[\frac{3}{2T} - \frac{1}{R}\frac{dR}{dT}\right] \tag{9}$$

where Vrn corresponds to the output reference voltage provided by reference signal source 40 and where $K=\beta_7/\beta_8$, with $\beta_7$ being the gain factor for field-effect transistor M7 and P8 being the gain factor the field-effect transistor M8. The term 3/2T is derived from the temperature coefficient of the transconductance KP of M8. The term 1/R[dR/dT] is the temperature coefficient of resistor Rc. R is the resistance Rc connected in series with M7 and M9 in the reference signal generating circuit shown in FIG. 2.

By setting dVrn/dT equal to zero, a value for K can be determined that will establish a zero temperature coefficient for the ring oscillator circuit When dVrn/dT is equal to zero, the reference voltage Vref is independent of temperature.

The term 3/2T can be derived from the temperature coefficient of the process transconductance $KP_8$ of M8 as follows.

$$\beta_8 = KP_8\left[\frac{W_{m8}}{L_{m8}}\right] \tag{10}$$

where $KP_8$ is the transconductance of M8 and $W_{m8}$ and $L_{m8}$ are the channel width and length of M8.

$$KP(T) = KP(T_o)\left(\frac{T}{T_o}\right)^{-1.5} \tag{11}$$

where $T_o$ is a reference temperature, such as ambient temperature, and T is the temperature of M8. Taking the derivative of equation (11) with respect to temperature:

$$\frac{dKP(T)}{dT} KP(T_o)\left(\frac{T}{T_o}\right)^{-1.5}\left[\frac{-1.5}{T}\right] \tag{12}$$

Setting T equal to $T_o$ in equation (12) and simplifying results in:

$$\frac{1}{KP}\cdot\frac{dKP}{dT} = -\frac{1.5}{T} = -\frac{3}{2T} \tag{13}$$

By way of example, a typical value of 3/2T is about 0.005/°C. The temperature coefficient of resistor Rc is about 2000 ppm/°C. The term dVth/dT typically evaluates to about −2.4 millivolts per °C. A typical value of $\beta_8$ is 180 microamps per volt. If K is chosen as 4, then $\beta_7=K\beta_8=720$ microamps per volt. The resistance Rc is about 4.5 Kohms.

A similar analysis can be carried out with respect to the reference voltage Vrefp provided by the reference signal source 42 to illustrate that the reference voltage Vrefp also is independent of temperature when the ratio of the gain factor $\beta_9'$ for field-effect transistor M9' and the gain factor $\beta_{10}'$ for the field-effect transistor M10' are properly selected. In carrying out this analysis, equation (9) can be modified by substituting Vrp for Vrn, the gain factors of M9' and M10' for the gain factors of M7 and M8, for example. As is the case for Vrefn, a typical value of 3/2T is about 0.005/°C. The term 1/R[dR/dT], the temperature coefficient for resistor Rc' is about 2000 ppm/20 C. The term dVthdT typically evaluates to about −2.4 millivolts per °C. A typical value of $\beta_{10}'$ is 180 microamps per volt If K is chosen as 4, then $\beta_9'=K\beta_{10}=720$ microamps per volt. The resistance Rc' is about 4.5 Kohms.

Referring to FIG. 1, for the purpose of describing the operation of the ring oscillator circuit provided by the present invention, it is assumed initially that power is not being applied to the circuit. At power up, $V_{cc}$ and $V_{ss}$ which is assumed to be ground potential, are applied to all the inverter stages and to the reference signal sources. Because the gate of M6 is connected to ground ($V_{ss}$), M6 is turned on and M3 is electrically connected to $V_{cc}$ through M6. Similarly, because the gate of M5 is connected to $V_{cc}$, M5 is turned on and M2 is electrically connected to ground through M5.

Assuming that the gates of M2 and M3 are initially at ground potential, the output of the first inverter stage 20(1) is at level $V_{cc}$ and this output is applied to the input to the second inverter stage 20(2) of the ring oscillator circuit. Therefore, the output of the second inverter stage 20(2) is at ground, etc. After propagating through an odd number of invertor stages, the output of the last inverter stage, inverter stage 20(N) in the exemplary embodiment, is at level $V_{cc}$. Accordingly, a voltage at level $V_{cc}$ is fed back to the input of the first inverter stage 20(1) at the gates of M2 and M3.

In the mean time, the reference voltages Vrefn and Vrefp become established and take control of the output resistance of each inverter stage. Once this happens, the switching time or time delay "t"of each inverter stage is defined and the frequency of the oscillation is defined for the ring oscillator circuit.

By way of example of an application of the ring oscillator circuit provided by the invention, the ring oscillator circuit can be incorporated into an integrated circuit memory system wherein the ring oscillator circuit provides drive signals for a charge pump which in turn provides row and column select signals for the memory array of the integrated circuit memory device. An example of one such integrated circuit memory device is a burst EDO memory device, such as that disclosed in U.S. patent application Ser. No. 08/370,761, entitled BURST EDO MEMORY DEVICE, by Zagar et al., and assigned to the assignee of the present invention, which application is incorporated herein by reference.

Figure 4:
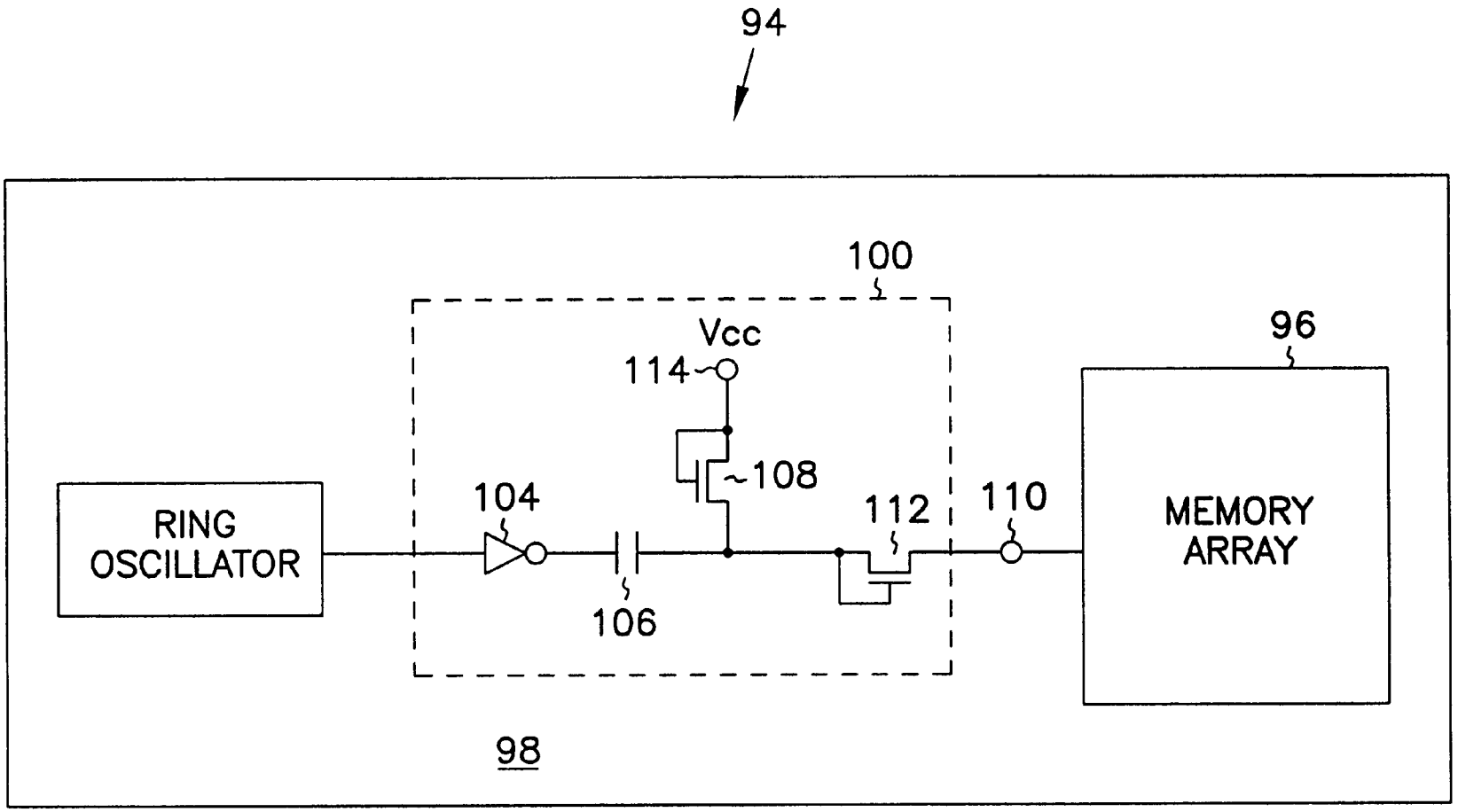
FIG. 4 is a partial schematic circuit and block diagram of a memory system including a charge pump that is driven by the ring oscillator circuit provided by the present invention.

Referring to FIG. 4, there is illustrated an integrated circuit memory system 94 including a memory array 96 formed on a die 98. The integrated circuit memory system 94 includes a charge pump 100 that is driven by the ring oscillator circuit provided by the present invention for providing drive signals for access transistors (not shown) of a memory array 96 of the integrated circuit memory system, all of which are formed on the die 98 using conventional integrated circuit techniques. The ring oscillator circuit provides a square wave oscillating signal having voltage swings between the supply voltage $V_{cc}$ and $V_{ss}$ or ground. The exemplary charge pump 100 is a basic single phase charge pump having an inverter 104 for sharpening the edges of the oscillating output signal of the ring oscillator circuit The charge pump includes a capacitor 106 that is discharged through the output 110 via diode connected transistor 112. Transistor 108 is coupled to the external power supply voltage, $V_{cc}$, at terminal 114.

When the ring oscillator circuit produces a voltage close to $V_{cc}$, the output of inverter 104 is low and circuit node 116 is approximately at the voltage of the power supply minus a threshold voltage ($V_{cc}$−Vt) as provided by transistor 108. When the ring oscillator circuit transitions to a low voltage, the output of inverter 104 goes high and boosts the charge on capacitor 106. The incremental charge on capacitor 106 is delivered to output 110 through transistor 112. The charge on capacitor 106 is therefore pumped above $V_{cc}$ to produce a voltage $V_{ccp}$. The voltage $V_{ccp}$ is used to drive access transistors (not shown) of the memory array 96 in the manner known in the art.

Although in the preferred embodiment, the ring oscillator circuit is described with reference to an application in an integrated circuit memory system in which the ring oscillator circuit provides drive signals for a charge pump of the memory system, it will be understood by those skilled in the art that the ring oscillator circuit of the invention can be used in other integrated circuit systems, and in discrete circuit systems, including counters, frequency dividers, frequency multipliers, phase locked loops, charge pumps, or any other circuit of such integrated circuit systems and discrete systems which require a constant clock frequency.

Conclusion

There has been described a frequency adjustable, zero temperature coefficient referencing ring oscillator circuit that includes a plurality of inverter stages each having a switching circuit and a control circuit. The switching circuit produces the oscillating output signal for the ring oscillator circuit and the control circuit controls the switching circuit to establish the frequency of the output signal. $T_o$ this end, the control circuit includes field-effect transistors which are operated as output resistance controllable devices and which have their operating points, and thus their output resistances, established by a reference voltage that is produced by a precision reference voltage generating circuit. Accordingly, the operating frequency of the ring oscillator circuit can be set by adjusting the value of the reference signals produced by the precision reference signal generating circuit and is maintained at the setpoint value because the precision reference voltage generating circuit operates independently of variations in temperature and/or the power supply voltage.

In accordance with a feature of the invention, the resistance components of the reference voltage sources which establish the values of the reference voltages are laser trimmable so that the reference voltages, and thus the operating frequency of the ring oscillator circuit, can be adjusted after testing. This obviates the need to fabricate the precision reference voltage sources to a precise resistance in order to obtain the reference voltage that is required to establish a desired operating frequency for the ring oscillator circuit.

While in a preferred embodiment, the ring oscillator circuit has been described with reference to an application with a charge pump circuit in an integrated circuit memory device for providing a precise time base signal for the charge pump which provides drive signals for an integrated circuit memory device. However, it will be understood by those skilled in the art that the ring oscillator circuit of the invention can be used in discrete circuit systems or in integrated circuit systems such as in counters, frequency dividers, frequency multipliers, phase locked loops, charge pumps, or any other circuit which require a constant clock frequency. The ring oscillator circuit includes a plurality of inverter stages each having a switching circuit and a control circuit for controlling the switching circuit. The ring oscillator circuit can be used in any integrated circuit system or any discrete system that requires a constant clock frequency.

Therefore, although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. An oscillator circuit suitable for providing an oscillator output based on a signal from a source, the oscillator circuit comprising:

a plurality of cascaded inverter stages, each inverter stage having a switching circuit operably coupled to a control circuit, wherein each switching circuit includes an inverter output and an inverter input, and wherein the inverter output of each stage is connected to the inverter input of the succeeding stage; and a reference circuit electrically connected to and biasing at least one control circuit, the reference circuit operably coupled to the source and providing a reference signal to the at least one control circuit wherein the reference signal is substantially independent of variations of the signal from the source.

2. The oscillator circuit of claim 1 wherein each inverter stage includes one inverter input.

3. The oscillator circuit of claim 1 wherein the reference circuit is operable over a range of different operating temperatures and wherein the reference signal is substantially independent of variations of the operating temperatures.

4. The oscillator circuit of claim 1 wherein the switching circuit of each inverter stage includes a pull-down stage when a first voltage is applied to the inverter input and a pull-up stage when a second voltage is applied to the inverter input where the first voltage is higher than the second voltage.

5. The oscillator of claim 4 wherein the oscillator output includes a frequency, and wherein the control circuit of each inverter stage controls the frequency with the pull-up and pull-down stages.

6. An oscillator circuit suitable for providing an oscillator output signal between a first voltage and a second voltage, the oscillator output signal based on a signal from a source, the oscillator circuit comprising:

a plurality of cascaded inverter stages, each inverter stage having a switching circuit, and a first and a second control circuits, wherein each switching circuit includes an inverter output and an inverter input, and wherein the inverter output of each stage is connected to the inverter input of the succeeding stage;

wherein the first control circuit is serially connected between a node at the first voltage and the switching circuit, and the second control circuit is serially connected between the switching circuit and a node at the second voltage;

a first reference circuit operated by the source, the first reference circuit electrically connected to and biasing the first control circuit; and a second reference circuit operated by the source electrically connected to and biasing the second control circuit;

wherein the first and second reference circuits are generally parametrically independent of variations of the source and the second voltage at the node.

7. An oscillator circuit for providing an oscillator output having a first voltage, a second voltage, and a frequency, the oscillator circuit having:

a reference circuit connected to a source generally at the first voltage and a node generally at the second voltage, providing a reference signal generally independent of the source and the voltage at the node; and a plurality of cascaded inverter stages operably connected to the reference circuit and wherein each inverter stage is responsive to the preceding inverter stage, each inverter stage including:

a switching circuit responsive to the preceding inverter stage and providing an inverter signal to the succeeding inverter stage;

a first control circuit serially connected between the switching circuit and the source; and a second control circuit serially connected between the switching circuit and the node;

wherein the first and second control circuits each having a resistance responsive to the reference signal of the reference circuit and wherein the frequency is generally responsive to the resistance of the first and second control circuits.

8. The oscillator circuit of claim 7 wherein the resistances of the first and second control circuit are generally equal to each other.

9. The oscillator circuit of claim 7 wherein each inverter stage includes a selectable high-to-low transition time and wherein the high-to-low transition times are generally the same for each inverter.

10. The oscillator circuit of claim 7 wherein the first and second control circuits include a current selectively flowing therethrough such that the resistance of the first and second control circuits is inverse-linearly responsive to the current.

11. The oscillator circuit of claim 10 wherein the current flow in each inverter stage is responsive to the inverter signal from the preceding inverter stage.

12. An oscillator circuit for use with a source, the oscillator circuit comprising:

a plurality of cascaded inverter stages each having an inverter input and an inverter output wherein the inverter output of each stage is connected to the inverter input of the succeeding stage; and a reference circuit operably coupled to and biasing the inverter stages, the reference circuit comprising:

a first circuit operably coupled to the source and providing a first voltage to each inverter stage, the first circuit generally independent from the source;

a second circuit operably coupled to the source and providing a second voltage which is less than the first positive voltage;

wherein the first and second positive voltages are generally independent of temperature and the source.

13. A method of constructing an oscillator circuit, the method comprising the steps of:

providing a plurality of cascaded inverter stages having an oscillator output signal including a selectable frequency;

providing a functional reference circuit coupled to the inverter stages, the reference circuit having a first output responsive to a first resistive element and second output responsive to a second resistive element, wherein the output signal frequency is responsive to the functional reference circuit;

operating the oscillator circuit;

detecting the output signal frequency of the operating oscillator circuit; and trimming at least one of the first and second resistive elements in response to the detected output signal frequency.

14. The method of claim 13 wherein the functional reference circuit is provided by integrated circuit techniques.

15. The method of claim 14 wherein the step of trimming includes trimming with a laser.

* * * * *